US006412564B1

(12) United States Patent
Senior, Jr. et al.

(10) Patent No.: US 6,412,564 B1
(45) Date of Patent: Jul. 2, 2002

(54) END FITTING AND METHOD FOR ATTACHING WELL SCREEN SEGMENTS

(76) Inventors: Roy F. Senior, Jr., 4545 E. Lincoln, Fresno, CA (US) 93725; Jeffrey G. Vincent, 1411 N. Whitney, Fresno, CA (US) 93703

( * ) Notice: Subject to any disclaimer, the term of this patent is extended or adjusted under 35 U.S.C. 154(b) by 0 days.

(21) Appl. No.: 09/488,403

(22) Filed: Jan. 20, 2000

Related U.S. Application Data

(63) Continuation-in-part of application No. 09/332,832, filed on Jun. 14, 1999.

(51) Int. Cl.[7] ..... E21B 43/08
(52) U.S. Cl. ..... 166/380; 166/231
(58) Field of Search ..... 166/227, 228, 166/231, 229, 380

(56) References Cited

U.S. PATENT DOCUMENTS 2,310,507 A * 2/1943 Bodey, Jr. ..... 166/231
2,346,647 A * 4/1944 Bennison ..... 166/231

* cited by examiner

*Primary Examiner*—William Neuder
(74) *Attorney, Agent, or Firm*—Charles E. Cates; Elizabeth A. Dawn

(57) ABSTRACT

The end fitting of the present invention is generally hollowly cylindrical in shape and sized so that the outer diameter of the end fitting is slightly larger than the outer diameter of the well screen to which the fitting is to be joined. Bores are formed in the body of the end fitting. The number and placement of bores in the end fitting should be such that the number and placement of bores in the end fitting match the number and placement of longitudinal rods in the well screen. The end fitting is mounted to the well screen by means of inserting each of the longitudinal rods of the well screen into each of the bores in the end fitting. The end fitting is permanently secured to the well screen by swaging the end fitting so that the fitting is compressed about the longitudinal rods. Alternatively, adhesive may be used to secure the longitudinal rods in the bores of the end fitting. In an alternative embodiment of the invention, the bores are drilled completely through the end fitting. The longitudinal rods are then inserted through the bores. To secure the rods within the bores, a swaging tool is used to deform the end fitting about the rods. Alternatively, the protruding ends of the longitudinal rods are welded to secure the rods in the end fitting. Following the welding operation the end fitting and longitudinal rods may optionally be swaged for a more secure attachment.

22 Claims, 3 Drawing Sheets

END FITTING AND METHOD FOR ATTACHING WELL SCREEN SEGMENTS

This is a continuation in part of U.S. Patent Application No. 09/332,832 filed Jun. 14, 1999. This invention relates to a new end fittings for attaching segments of continuous wire wrap well screens.

BACKGROUND

Well screen segments are placed through each water-bearing formation of a well. Although several different types of well screens are available, continuous wire wrap screens are generally preferred as the wire wrap screens provide the highest percentage of open area. Wire wrap screens have up to 37% open area while perforated pipe screens, the other type of commonly available well screen, have only up to 12% open area. It is desirable to install well screens with the highest open area possible as a higher open area allows water to enter the well more slowly. Excessive corrosion of the well occurs when water enters the well screen at a velocity greater than 0.1 foot per second. At speeds greater than 0.1 foot per second, solids drop out of the water and create too much encrustation and corrosion. Although debris can plug any well screen, the higher percentage of open area in wire wrap screens allows the wire wrap screen to continue to function because of its greater percentage of open area when a perforated pipe screen would be completely plugged.

Continuous wire wrap screens are made by wrapping a wire having a generally V-shaped cross-section around a series of longitudinal support rods to which the narrowest portion of the cross section of wire is welded or otherwise attached at every intersection to form inwardly opening flow slots. The wire and rods are generally made of metal, for its strength and corrosion resistance. Metals commonly used for well screens are mild steel, copper bearing steel, cor-ten steel, stainless steel and bronze. Well screens are manufactured in segments of a predetermined length. The segments of well screen are then attached by end fittings so that the section ofjoined well screen extends to the desired length.

The end fittings are conventionally made of the same metal as the screen and may be threaded at their outer ends to permit a threaded pipe or another length of well screen to be attached thereto. Alternatively, the outer ends of the end fittings are beveled to facilitate a fall penetration weld and then welded to another pipe or length of well screen.

When a well screen is installed in the borehole of the well, three forces act on the screen: column load, which is the vertical compression on the screen; tensile load, which is the extending force acting on the screen; and collapse pressure which is horizontal force acting on the screen. The well screen and end fittings which join the well screen segments must be strong enough to withstand these forces. The deeper the well, the greater the column and tensile load the well screen and casing must support. One segment well screen has to support the entire weight of the pipe extending above and below that segment. This burden exerts a column load on the screen, which is not a great force as the screen should be installed so that it hangs from of the pipe with no weight from the pipe resting on the screen. A tensile load is exerted on the screen when long sections of screen and casing are installed. The screen must have enough tensile strength to permanently hold any casing or screen suspended below it, which can be as much as 159,000 pounds to 209,000 pounds in extreme conditions. After the borehole annulus is gravel packed, earth pressures exert horizontal stresses on the screen. The screen must have adequate collapse resistance to withstand both earth and hydraulic pressures. In wells where the well borehole bends or slants, the well screen and its attaching end fittings are subject to even greater stresses. For continuous slot screens, the weight of the pipe column is supported by the cross-sectional area of the longitudinal rods and the end fittings. Because of the tremendous forces which end fittings must withstand, end fittings, especially in deeper wells or corrosive water, are made of metal.

End fittings are usually welded to the ends of the support rods and often must also be welded around of the periphery of the screen to the end wrap of wire. The welding operation adds greatly to the expense of attaching end fittings to well screens. Moreover, the melting caused by the welding process results in a loss of strength in the metal forming the longitudinal rods at the point of the weld. During the manufacture of the longitudinal rods, the strength of the rods is enhanced by work hardening. When the longitudinal rods are welded to an end fitting, the rods become partially annealed by the heat of the welding operation and lose part of their strength. As a result of the weld, longitudinal rod strength is diminished by at least 30%. Engineers typically estimate that another 50% of longitudinal rod strength is lost due to welding errors. As a result of the loss in strength caused by the welding process, well screen segments can break apart at the point of the weld to the end fittings. Accordingly, it is desirable to develop a process for attaching end fittings to support rods which does not require welding and which retains 100% of the longitudinal rod strength.

One method is taught by U.S. Pat. No. 4,819,722 to Daly. That patent teaches a plastic end fitting and method of attaching the plastic end fitting to a metal well screen. In Daly, the plastic fitting is secured to the well screen by melting the outer surface a portion of the fitting with a induction heating element which is wrapped around the well screen and fitting. Because metal end fittings provide greater strength and are more resistant to deformation by heat than plastic end fittings, it is still desirable to join a metal end fitting to a metal well screen without welding.

SUMMARY OF THE INVENTION

The metal end fitting of the present invention over the end fittings and means for joining end fittings to well screen taught in the prior art as the metal end fitting of the present invention can be joined to a well screen without the need for welding. The end fitting of the present invention is generally hollowly cylindrical in shape and sized so that the outer diameter of the end fitting is slightly larger than the outer diameter of the well screen to which the fitting is to be joined. Bores are formed in the body of the end fitting. The number and placement of bores in the end fitting should be such that the number and placement of bores in the end fitting match the number and placement of longitudinal rods in the well screen. The end fitting is mounted to the well screen by means of inserting each of the alongitudinal rods of the well screen into each of the bores in the end fitting. The end fitting is permanently secured to the well screen by swaging the end fitting so that the fitting is compressed about the longitudinal rods. The swaging process distorts the rod and bore from vertical in once or more areas, which binds the rod within the bore. The bond created by the swaging process is able to withstand greater tensile and collapse pressure than the longitudinal rods themselves. Alternatively, an adhesive may be used to secure the longitudinal rods in the bores of the end fitting. In an alternative embodiment of the invention, the bores are drilled completely through the end fitting. The longitudinal rods are then inserted through the bores. To secure the rods within the bores, a swaging tool is used to deform the end fitting about the rods. Alternatively, the protruding ends of the longitudinal rods are welded to secure the rods in the end fitting. Following the welding operation the end fitting and longitudinal rods may optionally be swaged for a more secure attachment.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
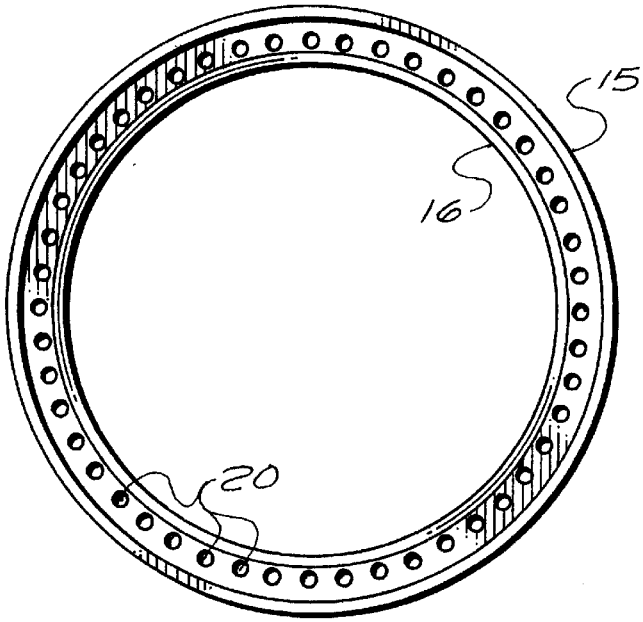
FIG. 1 is a bottom view of the end fitting of the present invention showing bores formed in the body of the end fitting.
Figure 2:
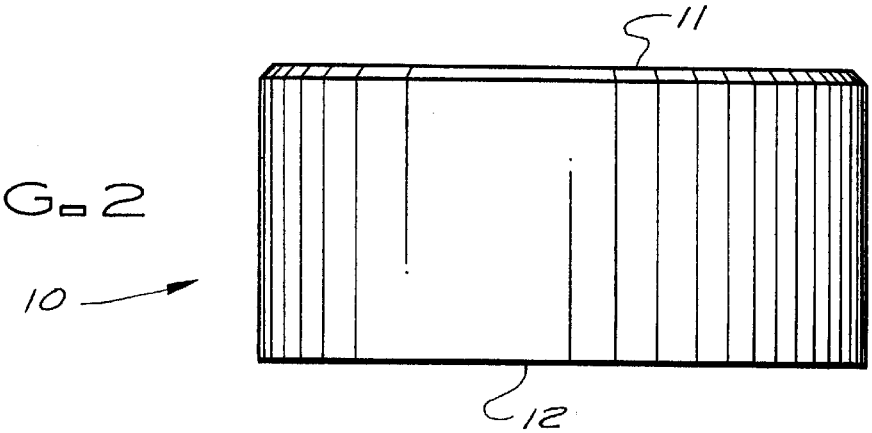
FIG. 2 is a side view of the end fitting of the present invention.
Figure 3:
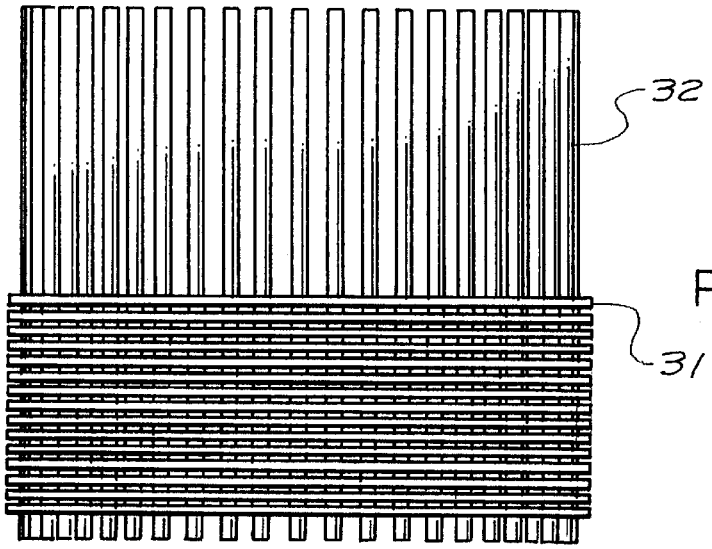
FIG. 3 is an elevational view of a continuous slot well screen showing the longitudinal rods extending beyond the wire wrapping of the screen.

As shown in FIGS. 1 and 2, the end fitting 1 of the present invention is a hollow cylindrical wall having an exterior surface 15, interior surface 16, top 11, bottom 12, and body 10 with bores 20 therein. The outer diameter of the end fitting 1 should be slightly larger than the outer diameter of the well screen 30 to which the fitting is to be joined.

As shown in FIG. 2, body 10 has top 11 and bottom 12. Bottom 12 is provided with bores 20 for engagement with longitudinal rods 32 of wire wrap screen 30. Conventionally, longitudinal rods 32 are cut even with the last wire wrap 31 of screen 30. However, in order to effectuate installation of end fitting 1 according to the present invention, longitudinal rods 32 should be cut so that they extend into the end fitting a distance sufficient to adequately secure the longitudinal rods within the end fitting by swaging or welding means as described below. In general, the heavier the wire wrap of screen 30 and the thicker the longitudinal rods, the greater the distance longitudinal rods 32 should extend beyond last wire wrap 31.

Figure 4:
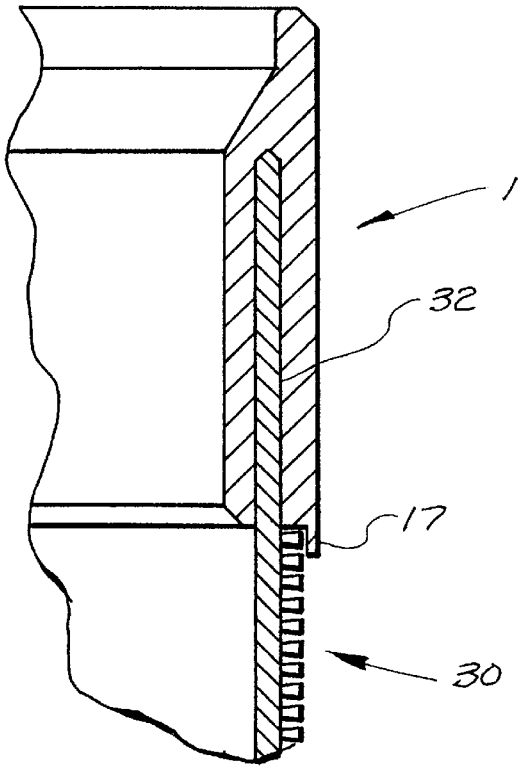
FIG. 4 is a section view showing the end fitting of the present invention mounted on the longitudinal rods of the well screen before swaging.
Figure 5:
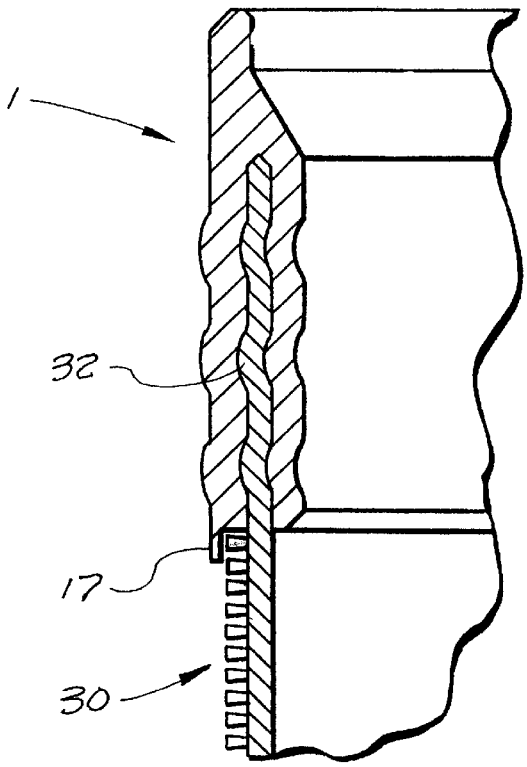
FIG. 5 is a sectional view showing the end fitting of the present invention in a swaged condition.

Bores 20 are located on bottom 12 of body 10 approximately midway between exterior surface 15 and interior surface 16. The number and placement of bores 20 in bottom 12 should be such that the number and placement of bores 20 match the number and placement of longitudinal rods 32 in the well screen 30. Bores 20 should be of sufficient length so that the portion of longitudinal rods 32 extending beyond wire wrap 31 can be completely inserted into the bores. As shown in FIGS. 4 and 5, lower lip 17 is continuous with exterior surface 15 and extends about .25 inch beyond bottom 12 of body 10. When end fitting 1 is mounted on well screen 30, lip 17 extends beyond the body 10 of the end fitting and down onto well screen 30 so that at least last wire wrap 31 is covered by lip 17.

End fitting 1 and well screen 30 can be made of a variety of steels of various chemical compositions, including mild steel, copper bearing steel, cor-tens steel, various stainless steels, and bronze. It is preferred that end fitting 1 be made of the same material as well screen 30 in order to prevent corrosion due to electrolysis caused by water flow across connecting metals of dissimilar chemical compositions.

As shown best in FIG. 4, by inserting longitudinal rods 32 into bores 20, end fitting 1 is mounted on well screen 30. In the preferred embodiment, a swaging tool is used to deform end fitting 1 about longitudinal rods 32. The swaging tool selected should have a male die with multiple protrusion and female die with matching grooves. The dies of the swaging tool are positioned on end fitting 1 so that one die is adjacent to interior surface 16 and the other die is adjacent to exterior surface 15. For an end fitting having a wall width of ¾ inch, about 30 tons of swaging power should be applied to press the male die of the swaging tool into the female die. The amount of swaging power necessary to create the bond between the end fitting and the longitudinal rods will vary with the screen rod diameter and the thickness of the end fitting. At a minimum, the swaging process should cause the longitudinal rods and surrounding end fitting to be distorted from the vertical a distance equal to at least half the diameter of the rods. As shown in FIG. 5, the swaging process results in end fitting 1 and longitudinal rods 32 being deformed such that the end fitting and rods are permanently joined. Joining end fitting 1 to longitudinal rods 32 by swaging results in 100% of the longitudinal rod strength being maintained at the point of attachment of the end fitting. Alternatively, a suitable adhesive may be used to permanently secure longitudinal rods 32 of screen 30 in end fitting 1.

Figure 6:
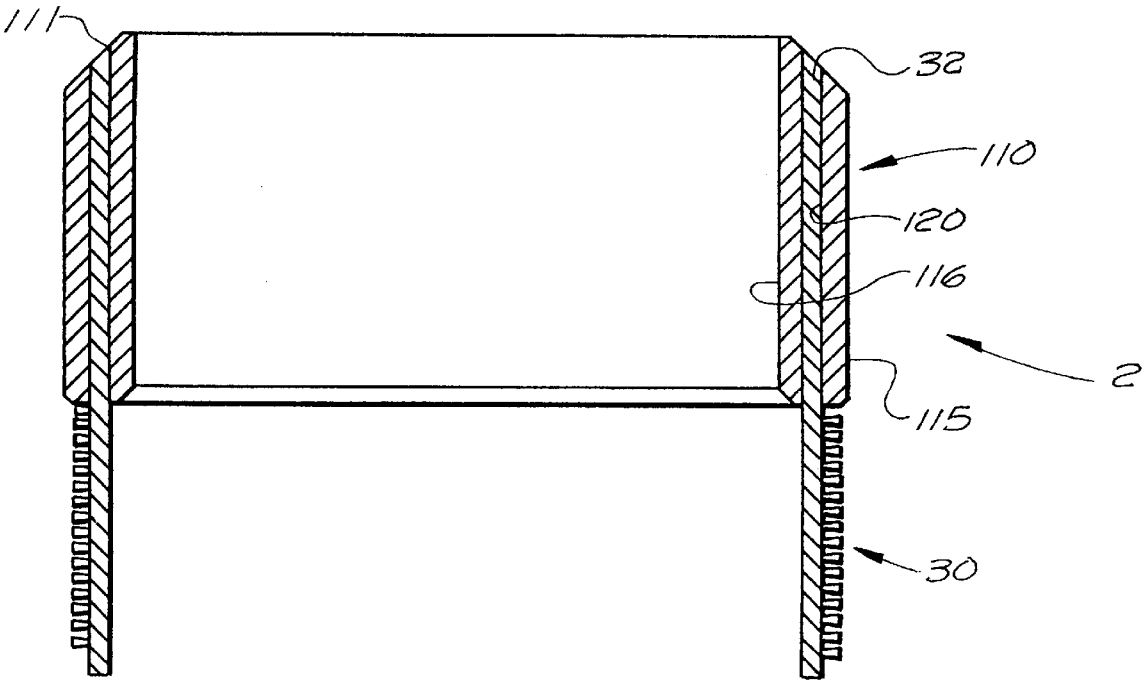
FIG. 6 is a sectional view showing an alternative embodiment of the end fitting of the present invention in which bores are drilled the entire length of the end fitting.
Figure 7:
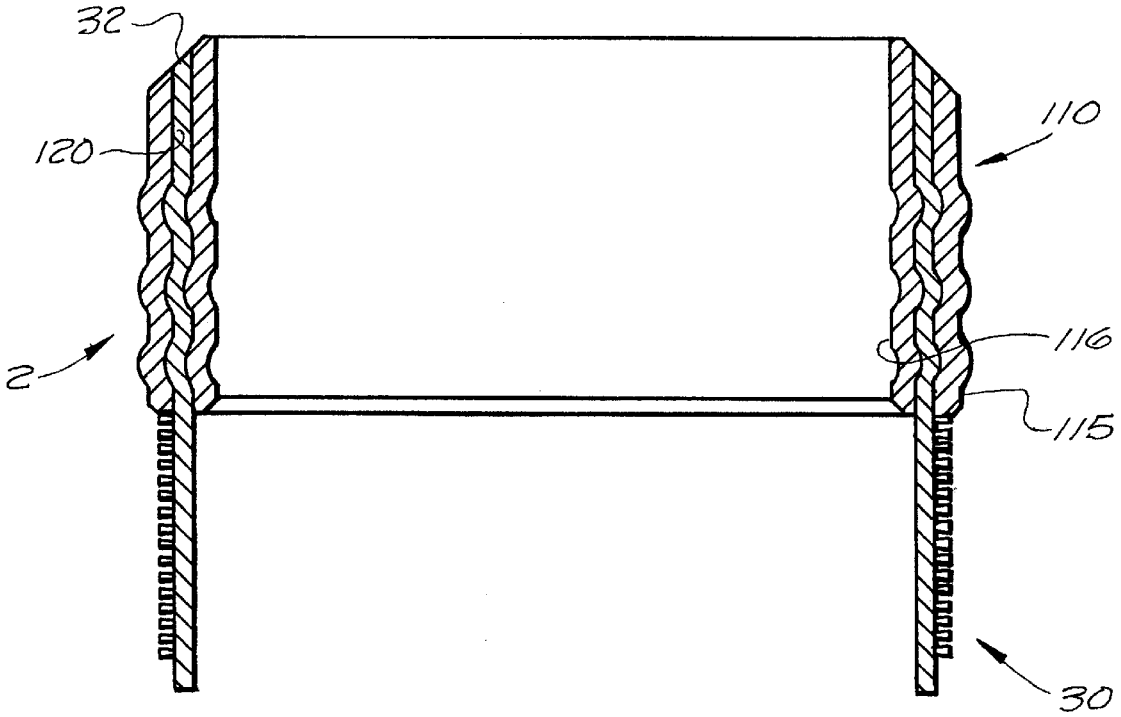
FIG. 7 is a sectional view showing an alternative embodiment of the end fitting of the present invention in which the longitudinal rods are inserted through the end fitting, welded and swaged.
Figure 8:
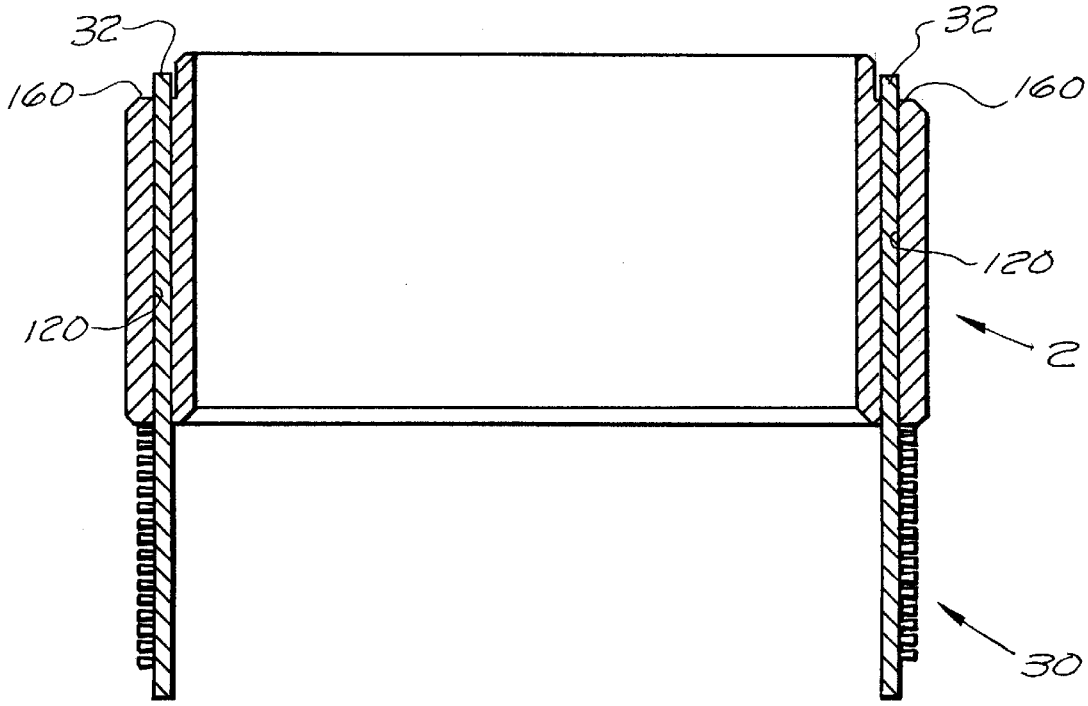
FIG. 8 is a sectional view showing an alternative embodiment of the end fitting of the present invention having a channel about the entire circumference of the end fitting.

In the alternative embodiment of the present invention shown in FIGS. 6 and 7, bores 120 extend through the entirety of body 110 of end fitting 2. Longitudinal rods 32 and body 110 are of such a length that, when rods 32 are inserted into bores 120, the rods protrude a short distance beyond the end fitting. As previously described, a swaging tool may be used to deform the end fitting about longitudinal rods 32. Alternatively, the portion of rods 32 which protrudes beyond the end fitting may be welded to secure longitudinal rods 32 within bores 120. When rods 32 are to be welded, it is preferred that a channel 160, shown in FIG. 8, be formed about the circumference of end fitting 2 to facilitate welding. When the welding process is completed, the weld can then be machined to form an even, beveled surface at top 111 as shown in FIGS. 6 and 7. It is believed that a superior weld is achieved by welding that portion of the longitudinal rods which protrude beyond the end fitting. As an additional measure, the end fitting 2 and welded longitudinal rods may be swaged for a more secure attachment as shown in FIG. 7. Because in this embodiment of the invention, longitudinal rods 32 extend all the way through body 110 to top 111, longitudinal rods 32 are incorporated into the weld joining two end fittings when segments of well screen are attached.

Once end fitting 1 is joined with longitudinal rods 32 on a section of well screen, top 11 of the end fitting can then be joined with another end fitting similarly joined with another segment of well screen or the well casing. The top 11 may be welded to the end fitting or well casing to be joined, or, alternatively, top 11 may be provided with threads for threaded engagement with the end fitting and well screen segment or well casing to be joined.

What is claimed is:

1. A continuous wire wrap well screen assembly comprising a segment of cylindrical metal well screen having a wire wrapped around and welded to a plurality of longitudinal support rods, said support rods being cut so that said rods extend a distance beyond the wrapping wire, and at least one end fitting secured to said well screen, said end fitting comprising a hollow cylindrical wall having an interior and exterior surface and having bores for receiving said support rods formed in said cylindrical wall between said interior and exterior surfaces, said support rods being received within said bores, said support rods then being permanently secured within said bores, a lip continuous with said exterior surface, said lip at least extending over a portion of said wire wrap of said well screen adjacent to said end fitting, and means for permanently securing said support rods within said bores.

2. The end fitting of claim 1 wherein said end fitting is metal.

3. The end fitting of claim 1 wherein said means for permanently securing said support rods within said bores is an adhesive.

4. The end fitting of claim 1 wherein said means for permanently securing said support rods within said bores is a swaging means used to deform said end fitting about said longitudinal rods.

5. The continuous wire wrap well screen assembly of claim 1 wherein said bores for receiving said support rods extend the entire length of said end fitting, said support/ rods being received within said bores and being permanently secured within said bores by a swaging means used to deform said end fitting about said support rods.

6. The continuous wire wrap well screen assembly of claim 1 wherein said bores for receiving said support rods extend the entire length of said end fitting, said support rods being received within said bores and protruding a distance beyond said end fitting, the protruding ends of said support rods then being welded to said end fitting so as to permanently secure said support rods within said bores of end fitting.

7. A The continuous wire wrap wel screen assembly of claim 6 wherein a swaging means is used to further secure said support rods within said bores of said end fitting.

8. A method for attaching an end fitting to a continuous wire wrap well screen comprising the steps of.

a. providing a continuous wire wrap well screen with longitudinal support rods cut so that said support rods extend a distance beyond the wrapping wire;

b. providing an end fitting comprising a hollow cylindrical wall having an interior and exterior surface;

c. providing means extending the entire length of said end fitting for receiving said longitudinal support rods in said end fitting between said interior and exterior surfaces;

d. inserting said longitudinal support rods into said means for receiving said longitudinal support rods; and e. permanently securing said longitudinal support rods in said end fitting.

9. The method of claim 8 wherein said end fitting is metal.

10. The method of claim 8 wherein said end fitting is provided with a lip continuous with said exterior surface, said lip at least extending over a portion of said wire wrap of said well screen adjacent to said end fitting.

11. The method of claim 8 wherein said longitudinal support rods are permanently secured in said end fitting by an adhesive.

12. The method of claim 8 wherein said longitudinal support rods are permanently secured in said end fitting by a swaging means used to deform said end fitting about said longitudinal rods.

13. The method of claim 8 wherein said swaging means includes a male die and a female die positioned on either side of said end fitting, said male die being pressed into said female die and thereby deforming said end fitting and said support rods so that said rods are permanently secured in said end fitting.

14. The method of claim 8 wherein said support rods are inserted into said means for receiving said longitudinal support rods so that said support rods protrude a distance beyond said end fitting.

15. The method of cliam 14 wherein said protruding ends of said support rods are welded to said end fitting to permanently secure said support rods within said bores of end fitting.

16. The method of claim 15 wherein a swaging means is used to further secure said support rods witlin said bores of said end fitting.

17. An end fitting,adapted to be secured to a continuous wire wrap well screen segment having a wire wrapped around and welded to a plurality of longitudinal/ support rods extending a distance beyond the wrapping wire, said end fitting comprising a hollow cylindrical wall having an interior and exterior surface and having bore means for receiving said longitudinal support rods formed in said cylindrical wall between said interior and exterior surfaces; said support rods secured in said end fitting by swaging.

18. The end fitting of claim 15 herein said means for receiving said longitudinai support rods are bores formed in said end fitting.

19. The end fitting of claim 17 wherein said end fitting is metal.

20. The end fitting of claim 17 wherein said end fitting is provided with a lip continuous with said exterior surface, said lip at least extending over a portion of said wire wrap of said well screen adjacent to said end fitting.

21. The end fitting of claim 18 wherein said end fitting is provided with a lip continuous with said exterior surface, said lip at least extending over a portion of said wire wrap of said well screen.

22. The end fitting of claim 17 wherein said means for receiving said longitudinal support rods extends the entire length of said end fitting.

* * * * *

UNITED STATES PATENT AND TRADEMARK OFFICE

CERTIFICATE OF CORRECTION

PATENT NO. : 6,412,564 B1 
DATED : July 2, 2002
INVENTOR(S) : Roy F. Senior, Jr. and Jeffrey G. Vincent It is certified that error appears in the above-identified patent and that said Letters Patent is hereby corrected as shown below:

Column 6,
Line 42, substitute -- 17 -- for "15".

Signed and Sealed this

Twelfth Day of November, 2002

*Attest:*

*Attesting Officer*

JAMES E. ROGAN
*Director of the United States Patent and Trademark Office*